US005182182A

United States Patent [19]

Takaoka et al.

[11] Patent Number: 5,182,182

[45] Date of Patent: Jan. 26, 1993

[54] ELECTROPHOTOGRAPHIC IMAGE-FORMING METHOD

[75] Inventors: Kazuhito Takaoka, Kadoma; Masatoshi Uehara, Hirakata; Yumiko Sano, Ibaraki, all of Japan

[73] Assignee: Mita Industrial Co., Ltd., Osaka, Japan

[21] Appl. No.: 558,240

[22] Filed: Jul. 26, 1990

[30] Foreign Application Priority Data

Jul. 31, 1989 [JP] Japan ..... 1-198523

[51] Int. Cl.[5] ..... G03G 13/14

[52] U.S. Cl. ..... 430/124; 430/126

[58] Field of Search ..... 430/126, 124, 98

[56] References Cited

U.S. PATENT DOCUMENTS 2,924,519 2/1960 Bertelsen ..... 430/124

3,124,457 3/1964 Schwertz ..... 430/126

4,272,179 6/1981 Seanor ..... 430/98

*Primary Examiner*—John Goodrow

*Attorney, Agent, or Firm*—Wenderoth, Lind & Ponack

[57] ABSTRACT

An image-forming method including the steps of forming a thin layer of a photosensitive toner charged to have a given polarity on a conductive drum, exposing said thin layer to light according to image information, and pressing a roller-type electrode against said toner thin layer through a transfer material after said exposing step to transfer a part of said photosensitive toner onto said transfer material. The method further includes the step of continuing contact between said conductive drum and said transfer material after said transfer material passes said roller-type electrode. Accordingly, a sharp toner image having a high density can be formed without the generation of fog.

1 Claim, 3 Drawing Sheets

ELECTROPHOTOGRAPHIC IMAGE-FORMING METHOD

FIELD OF THE INVENTION

The present invention relates to an image-forming method for forming an image by exposing a thin layer comprised of photosensitive toner to light to form an electrostatic latent image on the thin layer, and transferring the toner after exposed onto a transfer material. More particularly, the present invention relates to an improved electrophotographic image-forming method which makes it possible to eliminate fogging as maintaining a desirable density for images reproduced.

BACKGROUND OF THE INVENTION

Conventionally, an image-forming method using a so-called photosensitive toner functioning as both a developer and a photoconductor is known. In such a known method, a thin layer comprised of the toner having a photoconductivity is formed on a conductive drum, and the toner thin layer is then exposed to light to obtain a toner image.

FIG. 2 shows an example of the prior art image-forming method. Referring to FIG. 2, a toner thin layer 22 of a photosensitive toner 23 charged to have a given polarity by triboelectric charging or the like is formed on a toner retaining member 21 having a conductivity (the photosensitive toner 23 may be charged to have a given polarity by corona charging or the like after forming the toner thin layer). Then, exposure 24 according to an original image is applied to the toner thin layer 22. Accordingly, the toner is made conductive by the exposure 24, and the charge possessed by the toner is dissipated through the conductive toner retaining member 21 which is grounded, or a charge having a reverse polarity is injected into the toner. Thus, an electrostatic latent image 25 is formed on the toner thin layer. On the other hand, a transfer material 26 is brought into contact with the toner thin layer on which the latent image 25 has been formed, and a bias voltage is applied from a back side of the transfer material 26 as pressing a transfer roller 27 against the transfer material 26. As a result, the transfer material 26 is charged to have a polarity reversed to or the same as that of the toner not exposed, thereby transferring the toner onto the transfer material 26. In the former case where the transfer material is charged to have the reversed polarity, a positive image is formed, while in the latter case where the transfer material is charged to have the same polarity, a negative image is formed.

However, the above-mentioned transfer step is different from a general transfer process for transferring a toner image only formed on a photosensitive body in a xerography system which is represented by a Carlson process. That is, the transfer step as shown in FIG. 2 includes separating of the toner having a given polarity only from the toner thin layer having opposite polarities. If such a transferring and separating operation is carried out in the same manner as the above-mentioned xerography system wherein the toner image only formed on the photosensitive body is transferred, that is, if the transfer material is brought into contact with the toner thin layer on the conductive drum, and the transfer roller to which a bias voltage is applied from the back side of the transfer material is pressed against the transfer material to transfer the toner image onto the transfer material at the pressing point, and just thereafter separate the transfer material from the toner thin layer owing to the stiffness and the deadweight of the transfer material, the toner corresponding to a non-image portion is unnecessarily transferred onto the transfer material together with the toner corresponding to an image portion, resulting in the generation of fog. Thus, it is difficult to steadily form a sharp toner image having a high density with no fog.

SUMMARY OF THE INVENTION

It is an object of the present invention to provide an improved electrophotographic image-forming method which can eliminate the above-mentioned problem in the conventional electrophotographic image-forming method, and can form a sharp toner image having a high density and a high quality with no fog steadily and stably.

Accordingly to the present invention, there is provided an image-forming method comprising the steps of forming a thin layer of a photosensitive toner charged to have a given polarity on a conductive drum, exposing said thin layer to light according to image information, pressing a roller-type electrode against said toner thin layer through a transfer material after said exposing step to transfer a part of said photosensitive toner onto said transfer material, and continuing contact between said conductive drum and said transfer material after said transfer material passes said roller-type electrode.

The feature of the image-forming method according to the present invention is that the transfer material is not separated from the toner thin layer (conductive drum) at a position just after a pressing point between the transfer roller and the toner thin layer, but is continued to closely contact the toner thin layer and is then separated from the toner thin layer at a position suitably downstream of the pressing point.

In the conventional transferring and separating step using the transfer roller only, the toner in the toner thin layer is deformed by the pressure of the transfer roller to be applied to the conductive drum, resulting in an increase in contact area between the transfer material and the toner. Furthermore, the undesired toner corresponding to a non-image portion in the toner thin layer electrically repulsing the transfer material is influenced by both an increase in van der Waals' force and image force and an electrostatic force to be applied from the desired toner forming an image region having a reversed polarity. As a result, an adhesive force of the undesired toner adhering to the transfer material is increased. Under the condition, the transfer material is separated from the toner thin layer (conductive drum) at a position just after the pressing point of the transfer roller owing to the stiffness and the deadweight of the transfer material. For this reason, it is considered that the fog is generated. To the contrary, according to the image-forming method of the present invention, the separation of the transfer material from the toner thin layer (conductive drum) is not carried out by the transfer roller only. That is, the contact between the transfer material and the toner thin layer is continued even just after the pressing point between the transfer material and the toner thin layer, and the separation of the transfer material from the toner thin layer is carried out at a position suitably downstream of the pressing point. According to this feature of the present invention, until the toner made readily adhesive to the transfer material by the pressure deformation is returned to an original condition to reduce the adhesive force, the transfer material is maintained in contact with the toner thin layer. Accordingly, the adhesion of the undesired toner forming a non-image region to the transfer material may be prevented to thereby obtain a toner image having a high density without the generation of fog.

Other objects and features of the invention will be more fully understood from the following detailed description and appended claims when taken with the accompanying drawings.

DETAILED DESCRIPTION AND THE PREFERRED EMBODIMENTS OF THE INVENTION

The electrophotographic image-forming method of the present invention is embodied by using a suitable electrophotographic image-forming system for forming an image by forming an electrostatic latent image with use of a photosensitive toner and transferring the latent image onto a transfer material such as a sheet of paper.

Figure 4:
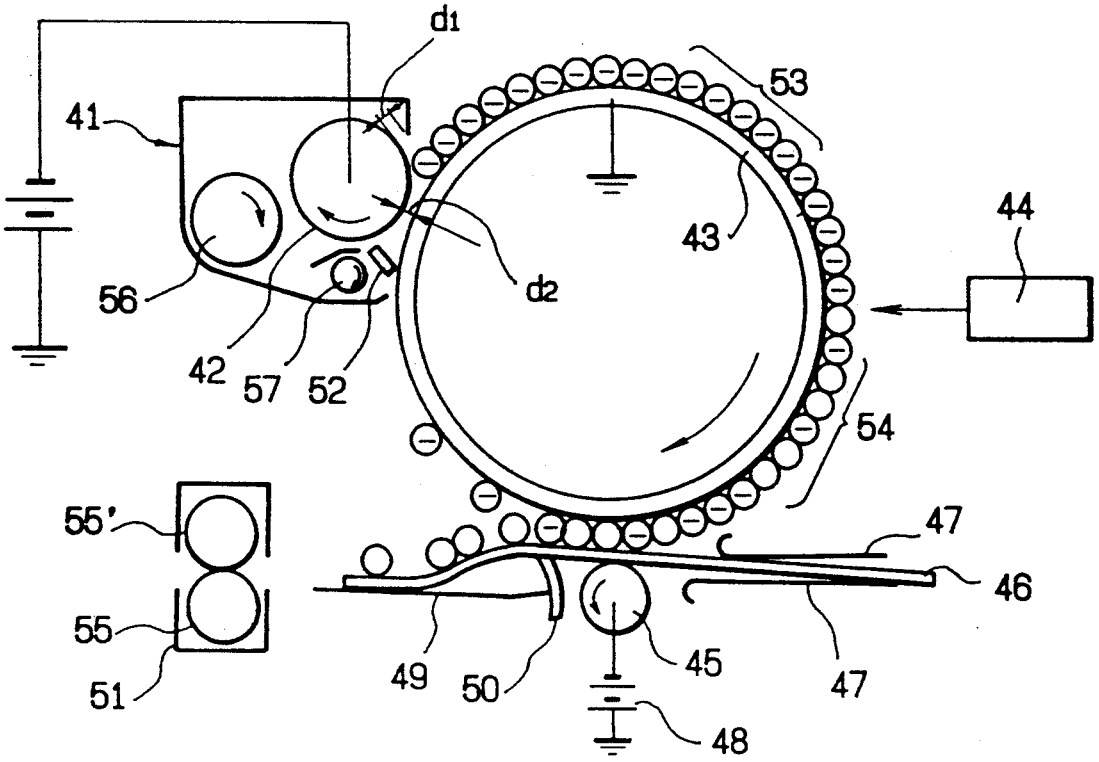
FIG. 4 is a schematic illustration of an image-forming device according to a preferred embodiment of the present invention.

A typical example of such an electrophotographic image-forming system is shown in FIG. 4. Referring to FIG. 4, a developing device 41 for uniformly forming a thin layer 53 of a photosensitive toner on a conductive drum 43 is provided at a left upper position with respect to the conductive drum 43 as viewed in FIG. 4. The developing device 41 includes a magnetic sleeve 42 and an agitating roller 56. A mixture of a ferrite carrier and the photosensitive toner is uniformly agitated by the agitating roller 56, and is fed to the magnetic sleeve 42 while a triboelectric charge is given to the photosensitive toner, whereby a magnetic brush of the mixture of the photosensitive toner and the carrier is formed on the magnetic sleeve 42. The magnetic brush formed on the magnetic sleeve 42 is rubbed on the conductive drum 43 to form the thin layer 53 of the photosensitive toner on the conductive drum 43. In actually forming the thin layer 53, the conductive drum 43 is grounded, and a bias voltage is applied from a power source 60, which is grounded, to the magnetic sleeve 42. Accordingly, a developing bias is operated between the magnetic sleeve 42 and the conductive drum 43 to carry out bias development with the operation of the triboelectric charge owned by the photosensitive toner.

The thin layer 53 of the photosensitive toner formed on the conductive drum 43 as mentioned above is fed to an exposure region by the rotation of the conductive drum 43. Exposure means 44 having a light source using a semiconductor laser is provided on a right side of the conductive drum 43 as viewed in FIG. 4. A laser beam is irradiated from the exposure means 44 to the thin layer 53 of the photosensitive toner according to image information. The photosensitive toner exposed is improved in its conductivity, and as a result, the charge, possessed by the toner is dissipated through the drum 43. As a result, an electrostatic latent image 54 having charge distribution is formed on the thin layer 53 of the photosensitive toner.

Thereafter, the photosensitive toner is fed to a transfer device provided under the drum 43 as viewed in FIG. 4. The transfer device includes a transfer roller 45 to which a transfer voltage is applied from a power source 48. The transfer roller 45 is pressed against a transfer material (paper) 46, and the photosensitive toner corresponding to the latent image is transferred onto the transfer material 46 by the transfer voltage. Thereafter, the paper 46 on which the photosensitive toner has been transferred is fed to a fuser 51, and is fixed by a heat roller 55' and a pressure roller 55 in the fuser 51. The remaining photosensitive toner not transferred but left on the conductive drum 43 is squeezed off from the drum 43 by a cleaning blade 52 provided under the magnetic sleeve 42 of the developing device 41, and is then fed to the agitating roller 56 by a feeding roller 57.

In such an image-forming device, the present invention improves the transfer device having the transfer roller 45 in order to well transfer the photosensitive toner. The improvement may be embodied by the construction as shown in FIGS. 1A or 1B, for example, wherein the contact between the transfer material (e.g., paper) and the toner thin layer is maintained for a predetermined time even just after the pressing point where the transfer roller is pressed against the toner thin layer.

Figure 1:
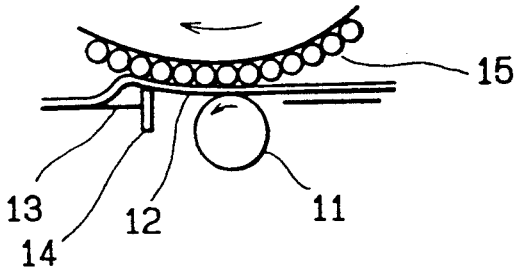
FIGS. 1A and 1B are schematic illustrations of different preferred embodiments of a transfer material pushing means to be employed in the image-forming method of the present invention.
Figure 1:
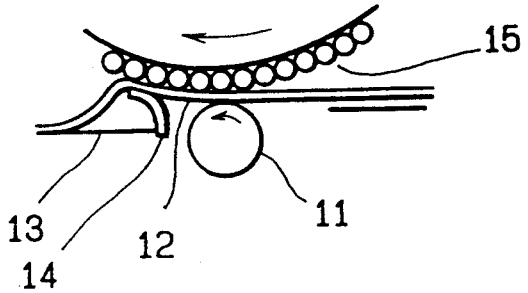
Figure 2:
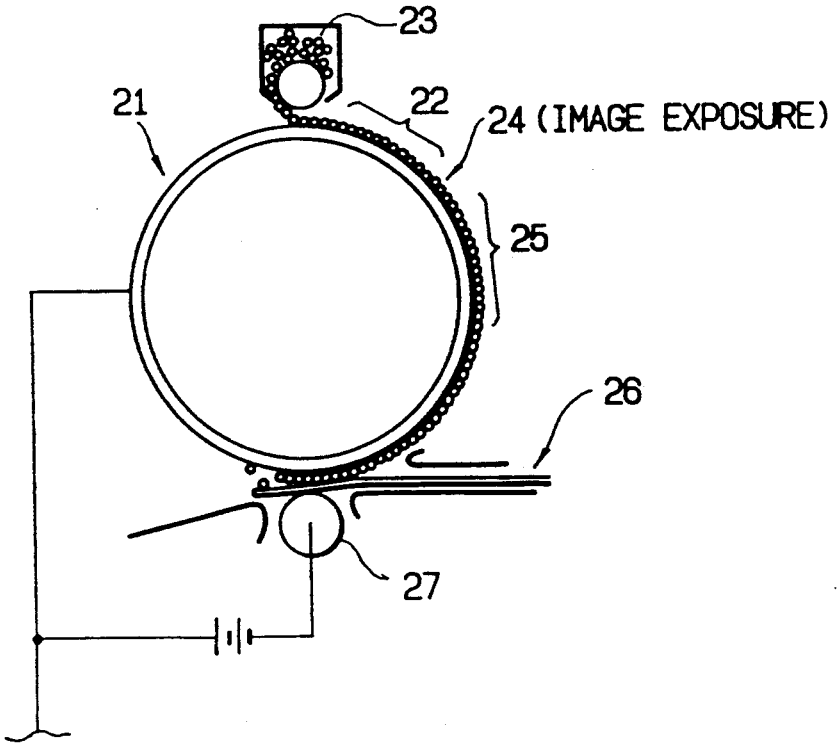
FIG. 2 PRIOR ART
FIG. 2 is a schematic illustration explaining the conventional image-forming process using a photosensitive toner and a transfer roller.

Such means for maintaining the contact between the transfer material and the toner thin layer (conductive drum) even just after the pressing point between the transfer roller and the toner thin layer (conductive drum) is not limited to the constructions as shown in FIGS. 1A and 1B. In the construction as shown in FIG. 1A, an insulating film 14 as the contact maintaining means (transfer material pushing means) mentioned above is attached to an upstream end of a paper feeding guide 14 provided on a downstream side of a transfer roller 11 for feeding a transfer material 12 having passed the transfer roller 11 to a fuser (not shown). An upper end of the insulating film 14 operates to push up the transfer material 12 having passed the transfer roller 11 so as to maintain the contact between the transfer material 12 and the toner thin layer 15. On the other hand, in the construction as shown in FIG. 1B, an insulating film 14 similar to that shown in FIG. 1A is so provided as to make surface-contact with the transfer material 12 and urge the same under pressure, so as to maintain the contact between the transfer material 12 and the toner thin layer 15.

While a contact pressure of the transfer material pushing means against the conductive drum depends upon a rotating speed of the conductive drum, a contact pressure of the transfer roller, and a kind of the toner to be used, which will be hereinafter described, it is in general suitably decided to the range of 4 to 6 g/cm$^2$.

The location of the transfer material pushing means may be decided according to a period of time to be defined in such that the pressure deformation of the toner can be sufficiently released, and a memory property of the photosensitive toner is not reduced. In a preferred embodiment, the transfer material pushing means is located at a position such that the transfer material can be separated from the toner thin layer at the time of 0.1 to 1.2 sec after the transfer material passes the transfer region (i.e., the pressing point between the transfer roller and the conductive drum). For example, when the rotational speed of the conductive drum is in the range of 80 to 100 mm/sec, and the toner thin layer is formed by using a photosensitive toner having a charging quantity of 8 to 10 μC/g to follow the formation of an electrostatic latent image by exposure, the above-mentioned time after passing of the transfer material through the transfer roller may be set to 0.3 to 1.0 sec.

The contact pressure of the transfer roller is suitably set so that the transfer material may be sufficiently brought into close contact with the toner thin layer. It is desired that the contact pressure is generally set to 0.5 to 1.8 kgf/cm$^2$, preferably 0.7 to 1.1 kgf/cm$^2$. If the contact pressure is larger than the above, range, an image density is sufficient but the deformation of the toner due to the pressure becomes large to cause easy adhesion of the toner to the transfer material, resulting in the generation of fog. On the other hand, if the contact pressure is smaller than the above range, the image density tends to be reduced. Further, in a negative system (an image region is formed by a toner having a charge decayed by exposure), the toner into which no charge or a charge of reversed polarity has been injected is transferred from the toner thin layer charged to a given polarity onto the transfer material. Accordingly, it is desired that the bias voltage to be applied to the transfer roller is generally set to ±200 to ±1000 V, particularly ±400 to ±900 V.

The transfer roller may be formed of any known materials to be employed in this field. For example, it may be a conductive roller constructed of a conductive metal shaft and a conductive elastic rubber surface or a dielectric roller having a dielectric surface.

The photosensitive toner to be used in the present invention may be a known photosensitive toner in itself. For example, it may be selected from particles of composition formed by dispersing a photoconductive pigment in an electrical insulating resin medium. Examples of the photoconductive pigment may include an inorganic photoconductor such as zinc oxide and cadmium sulfide, and a photoconductive organic pigment such as perylene pigment, quinacridon pigment, pyranthrone pigment, phthalocyanine pigment, disazo pigment and trisazo pigment. The photoconductive pigment may be used in a proportion of 3 to 600 parts by weight, preferably 5 to 500 parts by weight versus 100 parts by weight of the fixing resin medium. If the proportion of the photoconductive pigment is smaller than the above range, an image density or a toner sensitivity tends to be reduced. On the other hand, if the proportion is larger than the above range, a charge retentivity tends to be reduced.

The fixing resin medium may be selected from a known electrical insulating resin and a photoconductive resin such as polystyrene, styrene-acrylic copolymer, acrylic resin, polycarbonate, polyallylate, polyester and polyvinylcarbazole. Such a photoconductive resin may be used solely or in combination with the electrical insulating resin. Further, a known dye sensitizer or chemical sensitizer may be compounded in the fixing resin, so as to provide a sensitivity to a monochromatic light having a given wavelength range. In addition to the above essential components, a known auxiliary such as an offset prevention agent and a pressure fixation promoting agent such as wax.

It is desired that a particle size of the toner in median on the basis of a volume is in the range of 6 to 12 μm, preferably 8 to 10 μm. Further, it is also desirable that a standard deviation (σ) of distribution of the particle size on the basis of a volume is 3.33 μm or less, preferably 2.24 μm or less. If the particle size of the toner is larger than the above range, a charging quantity per unit weight is small. As a result, a contrast between an image portion and a non-image portion is reduced, and the toner corresponding to the non-image portion tends to be deposited onto the transfer material. On the other hand, if the particle size of the toner is smaller than the above range, a light decay speed per particle of the toner is large, but it is difficult to obtain a desirable thickness of the toner thin layer. Further, if the standard deviation (σ) of the particle size distribution is larger than the above range, the above defect tends to occur because a small-size particle portion and a large-size particle portion are present in the toner thin layer. As a result, mixing of colors and the fogging tend to occur.

In the present invention, it is preferable that the thickness of the toner thin layer is in the range of 6 to 30 μm, particularly 10 to 25 μm. Accordingly, considering the above-mentioned range of the particle size of the toner, the number of the toner thin layer is desired to be in the range of 1.5 to 2.5.

The conductive drum on which the toner thin layer of the photosensitive toner is to be formed is required to have at least a conductive surface on which the toner thin layer is to be formed, so as to maintain the conductivity. For example, the conductive surface may be formed of metal such as aluminum.

Figure 3:
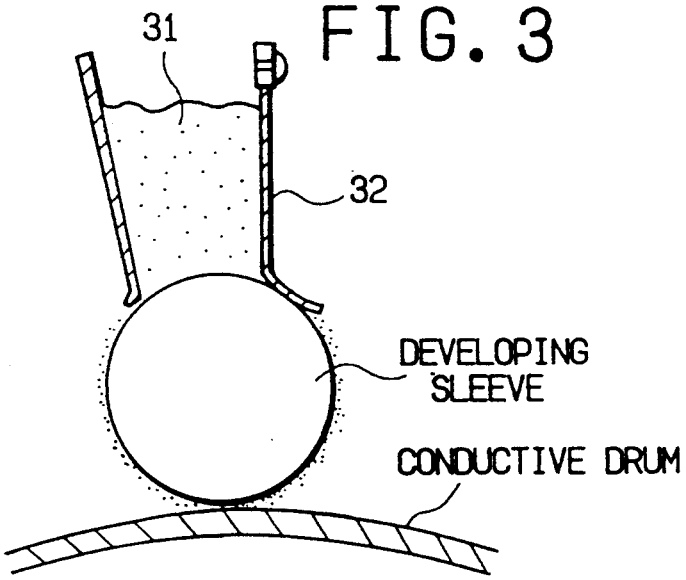
FIG. 3 is a schematic illustration of a preferred embodiment of a toner supply means for forming a toner thin layer according to the present invention.

As to a method of supplying the toner onto the conductive drum and forming the toner thin layer on the conductive drum, a magnetic brush method may be employed to form a magnetic brush of a mixture of the toner and a magnetic carrier on the magnetic sleeve as mentioned previously with reference to FIG. 4. In another preferred embodiment as shown in FIG. 3, the toner thin layer may be formed from a photosensitive toner 31 only by providing an elastic blade 32 formed from a rubber plate or a metal plate such as phosphor bronze and stainless steel and elastically pressing the elastic blade 32 against a developing sleeve 33.

The magnetic carrier to be employed in supplying the toner according to the magnetic brush method may be selected from an iron carrier or a ferrite carrier. The shape of the carrier may be arbitrary such as indeterminate form, rounded indeterminate form and spherical form, and it is desired that the particle size of the carrier is preferably in the range of 30 to 120 μm, more preferably in the range of 60 to 90 μm. The carrier may be uncoated or coated with resin. Further, it is desired that a mixing ratio by weight of the magnetic carrier and the photosensitive toner is preferably in the range of 96:4 to 92:8, more preferably in the range of 95:5 to 93:7. In the case of the magnetic brush method, it is desirable that a brush cutting clearance is preferably in the range of 0.5 to 1.2 mm, more preferably in the range of 0.8 to 1.0 mm.

The image exposure can be selected from transparent exposure through a transparent electrode or reflective exposure from an opaque original. In modifications, it may be selected from a method using a light emitting device array connected to a signal source, a method using an optical fiber for transmitting a light image, or a method of scanning a laser beam optically modulated.

After transferring the toner image onto the transfer material in accordance with the above-mentioned method, the fixing of the toner image may be carried out by a known fixing method to be employable in this field.

In the following, some examples of the present invention will be described. However, it is to be noted that the present invention should not be limited to these examples.

EXAMPLE 1

In accordance with the following recipe, a photosensitive toner having an average particle size of 10 μm was obtained.

| | |
|---|---|
| Zinc Oxide (Hakusui Kagaku Grade #2) | 300 parts by weight |
| Styrene-Acrylic Resin (Mitsui Toatsu PA525) | 100 parts by weight |
| Cyanine Pigment (Nippon Kanko Shikiso NK1414) | 0.3 parts by weight |
| Black Perylene Pigment (BASF L0086) | 5 parts by weight |

The photosensitive toner obtained above was mixed with a ferrite carrier in the ratio of 5:95 to prepare a developer. The developer prepared above was applied to the image-forming device shown in FIG. 4 to carry out image formation.

The development was conducted under the following conditions of; a brush cutting clearance (d1) of 0.9 mm, a drum-sleeve distance (d2) of 1.15 mm, a drum peripheral speed of 90 mm/sec, and a toner charging quantity of −9 uC/g. Under the above development conditions, a bias voltage of −300 V having the same polarity as that of the charge of the toner was applied to the magnetic sleeve 42 to form a toner thin layer constituted of two layers on the conductive drum 43. In the developing device 41, the agitating roller 56 is provided to uniformly mix the photosensitive toner and the carrier and uniformly form a magnetic brush on the magnetic sleeve 52, and the feeding roller 57 is also provided to feed the photosensitive toner recovered by the cleaning blade 52 to the agitating roller 56.

Then, the toner thin layer deposited on the conductive drum 43 was exposed by the semiconductor laser 44 according to image information to form an electrostatic latent image 54 which was in turn fed to the transfer device.

The transfer device includes the transfer roller 45 adapted to be moved to and away from the conductive drum 43. That is, only when the paper 46 as the transfer material is present on the transfer roller 45, the transfer roller 45 is brought into pressure contact with the conductive drum 43 by a well-known actuating means such as a solenoid (not shown). In Example 1, the contact pressure of the transfer roller 45 to the conductive drum 43 was set to 0.7 kgf/cm$^2$.

A pair of upper and lower paper feeding guide plates 47 are provided on an upstream side of the transfer roller 45 with respect to a feeding direction of the paper 46, so as to define the feeding direction of the paper 46 in such a manner as to prevent a leading end of the paper 46 from directly penetrating into the toner thin layer formed on the conductive drum 43 over the transfer roller 45. That is, the guide plates 47 operate to guide the paper 46 in such a manner that the leading end of the paper 46 is first brought into abutment against the transfer roller 45 separated from the conductive drum 43, and the paper 46 is then raised to contact the toner thin layer on the conductive drum 43 by the transfer roller 45 shifted from the separative condition to the contact condition.

The transfer roller 45 is constructed of a metal core and a conductive rubber (carbon-contained chloroprene rubber) formed around the metal core.

Another feeding guide plate 49 is also provided on a downstream side of the transfer roller 45 with respect to the feeding direction of the paper 46, so as to assist the feeding of the paper 46. A contact maintaining means 50 for maintaining the contact between the paper 46 and the toner thin layer is mounted on an upstream end of the guide plate 49. The contact maintaining means 50 extends along an axis of the conductive drum 43 over the axial length thereof. In Example 1, the contact maintaining means 50 was formed from an insulating polyethylene terephthalate film (100 um in thick). By the provision of the contact maintaining means 50, the paper 46 was separated from the toner thin layer at a position downstream of the pressing point of the transfer roller 45. The time from the pressing of the transfer roller 45 to the separation of the paper 46 was 0.175 sec at the drum peripheral speed of 90 mm/sec. Further, a voltage applied to the transfer roller 45 was −800 V. A volume resistivity of the paper 46 was $8\times10^{12}\Omega\cdot$cm, and a basis weight of the paper 46 was 63.5 g/m$^2$.

The paper 46 after the transferring step was fed to the fuser 51 including the heat roller 55' and the pressure roller 55, so that the toner image was fixed on the paper 46. The remaining toner not transferred was recovered to the developing device 41 by the cleaning blade 52 provided in the developing device 41.

An image density (reflective density) and a fog density in Example 1 were 0.607 and 0.005, respectively, and the image was sharp.

For the purpose of comparison, image formation was carried out under the same conditions as in Example 1 except that the contact maintaining means 50 was not provided to separate the paper 46 at a position just after the pressing point of the transfer roller 45. An image density (reflective density) and a fog density in this comparative test were 0.593 and 0.012, respectively, and the image was not sharp with edge blur and fog observed.

EXAMPLE 2

In Example 1, the transfer roller 45 was located under the conductive drum 43, and the insulating polyethylene terephthalate film as the contact maintaining means 50 was used to maintain the contact between the paper 46 as the transfer material and the toner thin layer by positively raising the paper 46.

Figure 5:
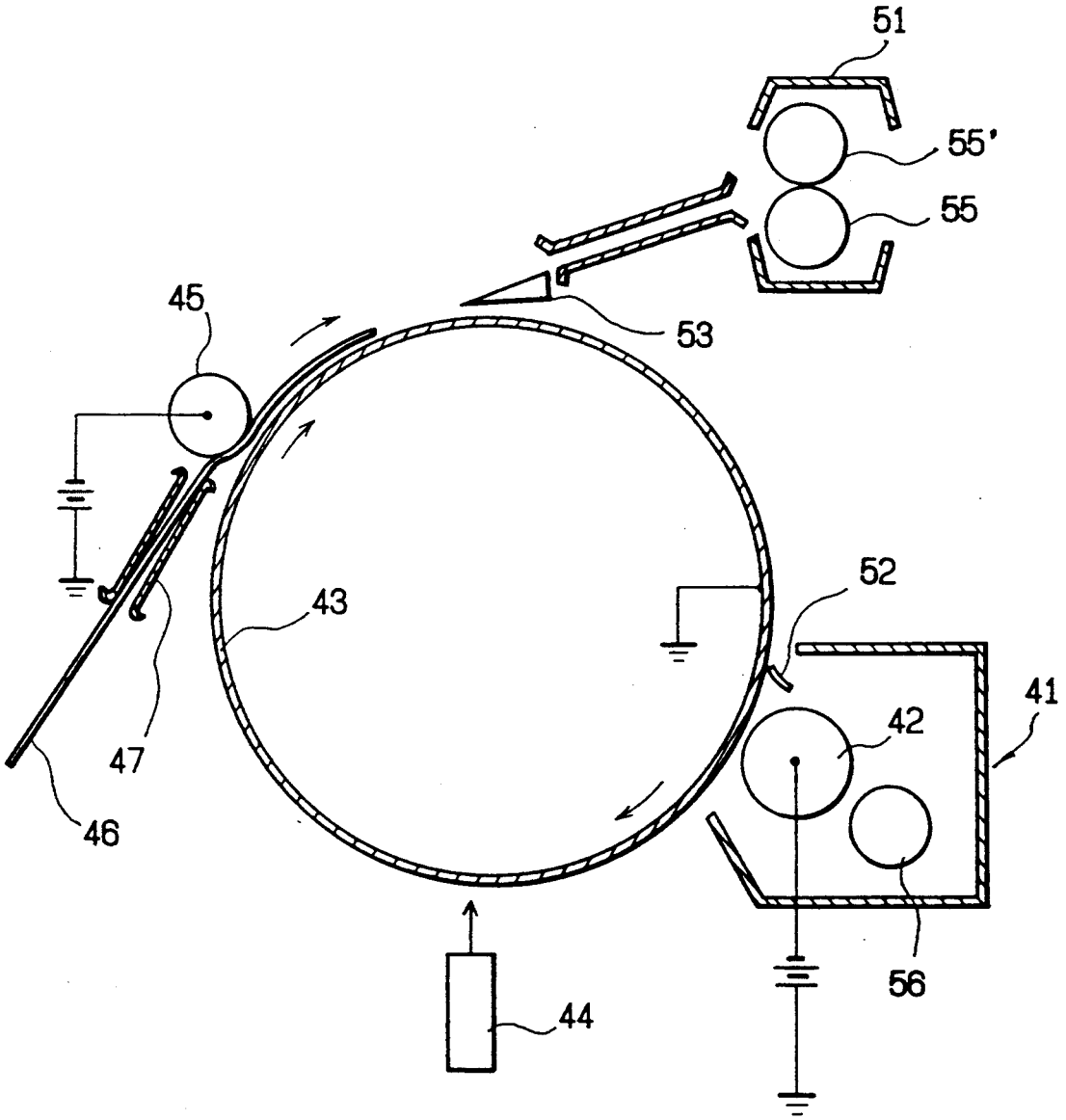
FIG. 5 is a view similar to FIG. 4, showing another preferred embodiment of the present invention.

In Example 2 as shown in FIG. 5, the transfer roller 45 is located at a position in a second quadrant, and the film as used in Example 1 was not provided. By locating the transfer roller 45 at this position, the contact between the paper 46 and the toner thin layer is maintained by utilizing the deadweight of the paper 46.

The image formation in Example 2 was carried out under basically the same conditions as in Example 1 except that the developing device 41 was located at a position in a fourth quadrant; the exposure means 44 was located under the conductive drum 43; and the transfer roller 45 is located at a position in the second quadrant.

The paper 46 passed the pressing point of the transfer roller 45 was maintained in contact with the toner thin layer for 0.4 sec by its deadweight. In this course, the paper 46 was fed in a direction as depicted by an arrow 58 as contacting the toner thin layer. Then, the paper 46 was separated from the toner thin layer by a separation claw 53. Thereafter, the paper 46 was fed through the guide plates 49 to the fuser 51. The fuser 51 includes the heat roller 55' containing a heater therein and the pressure roller 55.

An image density (reflective density) and a fog density in Example 2 were 0.60 and 0.007, respectively, and the image was sharp as similar to the image obtained in Example 1.

Next, using the above image-forming device, the image formation was carried out with the basis weight of the paper varied. The test result is as follows:

| Basis Weight of Paper ($mg/cm^2$) | Image Density | Fog Density |
|---|---|---|
| 63.5 | 0.60 | 0.006 |
| 73.7 | 0.59 | 0.005 |
| 75.2 | 0.62 | 0.003 |
| 80.8 | 0.53 | 0.005 |

All the images obtained in this test were sharp. In the case of using the paper having a basis weight of 80.8 $mg/cm^2$ in this test, fog was slightly observed at a leading end portion of the paper. It is considered that such fog was caused by the fact that the paper having a large basis weight is stiff to less the contact between the leading end portion of the paper and the drum.

As described above, according to the image-forming method of the present invention using a photosensitive toner, a sharp toner image having a high density can be formed without the generation of fog.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What we claim is:

1. An electrophotographic image-forming method comprising the steps of:

(a) forming a thin layer comprising photosensitive toner charged to have a given polarity on a conductive drum, (b) exposing said thin layer to light according to image information, (c) pressing a roller-type transfer electrode comprising a conductive roller having a conductive elastic rubber surface against said toner thin layer through a transfer material at a contact pressure of 0.5 to 1.8 $Kgf/cm^2$ after said step (b) to transfer a part of said photosensitive toner onto said transfer material, and (d) maintaining the contact between said toner thin layer on the conductive drum and said transfer material for a period of 0.1 to 2 seconds by applying a pushing pressure with a pushing-up member after said transfer material passes said roller-type transfer electrode.

* * * * *